United States Patent [19]

Matsumoto et al.

[11] 4,452,195

[45] Jun. 5, 1984

[54] LUBRICATING SYSTEM FOR OUTBOARD MOTORS

[75] Inventors: Kuniyoshi Matsumoto; Katsuya Ishimatsu, both of Hamamatsu, Japan

[73] Assignees: Yamaha Hatsudoki Kabushiki Kaisha; Sanshin Kogyo Kabushiki Kaisha, both of Japan

[21] Appl. No.: 483,226

[22] Filed: Apr. 8, 1983

[30] Foreign Application Priority Data

May 26, 1982 [JP] Japan ..... 57-88067

[51] Int. Cl.[3] ..... F02F 7/00; F02B 75/18

[52] U.S. Cl. ..... 123/195 AC; 123/59 B; 123/73 R; 123/192 R; 123/195 R; 123/196 W; 184/6.18

[58] Field of Search ..... 123/196 R, 196 CP, 196 W, 123/59 B, 73 A, 73 R, 73 AD, 52 MV, 55 V, 52 M, 195 R, 195 AC; 184/6.18

[56] References Cited

U.S. PATENT DOCUMENTS

| | | | |
|---|---|---|---|
| 2,333,524 | 11/1943 | Conover et al. | 123/196 W |
| 2,459,594 | 1/1949 | Smith | 123/59 B |
| 2,725,118 | 11/1955 | Clark | 184/6.18 |
| 4,023,547 | 5/1977 | Reisacher | 123/195 R |
| 4,033,312 | 7/1977 | Howe | 123/196 R |
| 4,066,057 | 1/1978 | Hale | 123/193 CH |
| 4,092,958 | 6/1978 | Hale | 123/73 A |
| 4,121,551 | 10/1978 | Turner | 123/196 CP |
| 4,184,462 | 1/1980 | Hale | 123/55 V |
| 4,187,809 | 2/1980 | Lanpheer | 60/313 |
| 4,244,332 | 1/1981 | Kusche | 123/52 M |
| 4,261,305 | 4/1981 | Ikoma | 123/73 A |
| 4,266,514 | 5/1981 | Tyner | 123/59 B |

FOREIGN PATENT DOCUMENTS

| | | | |
|---|---|---|---|
| 2302143 | 7/1974 | Fed. Rep. of Germany | 123/196 R |
| 575630 | 2/1946 | United Kingdom | 123/196 W |

*Primary Examiner*—Charles J. Myhre
*Assistant Examiner*—E. Rollins Cross
*Attorney, Agent, or Firm*—Ernest A. Beutler

[57] ABSTRACT

An improved lubricating system for a two-cycle internal combustion engine having a vertically disposed crankshaft. In accordance with an embodiment of the invention, the crankshaft has a connecting rod journal that rotates in a crank chamber above which is positioned a lubricant chamber. A lubricant delivery passage extends through the crankshaft from the lubricant chamber and terminates in a connecting rod journal portion formed in the crank chamber.

9 Claims, 1 Drawing Figure

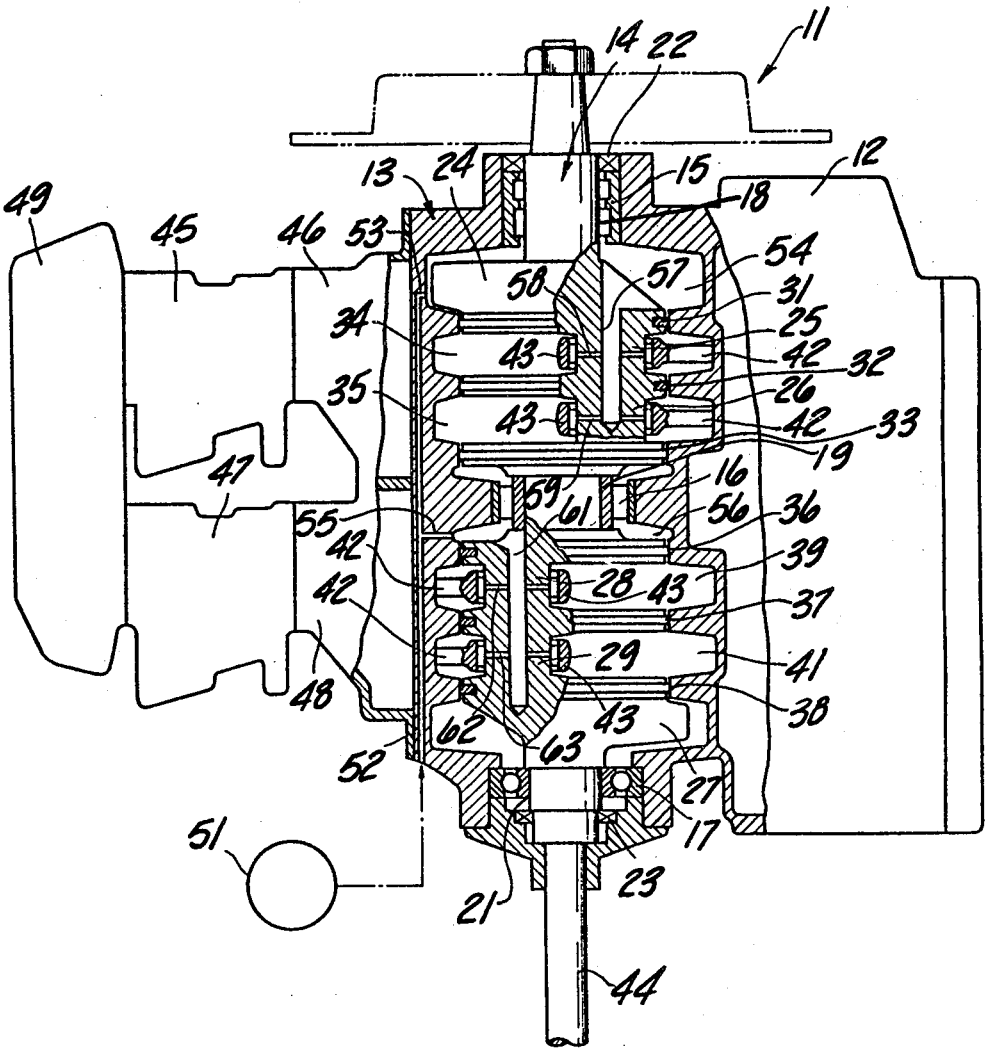
11
14
22
12
13
24
15
18
49
45
46
53
54
58
57
31
34
25
43
42
32
35
26
43
42
33
19
47
16
59
61
56
36
55
39
42
28
43
37
42
29
41
48
38
43
62
63
52
27
17
51
23
21
44

LUBRICATING SYSTEM FOR OUTBOARD MOTORS

BACKGROUND OF THE INVENTION

This invention relates to a lubricating system for outboard motors and more particularly to an improved lubricating system for two-cycle engines.

Two-cycle internal combustion engines have been conventionally lubricated by mixing lubricant with the fuel that is inducted to the engine. Although such arrangements obvious afford simplicity, they do not necessarily insure adequate lubrication of all highly stressed components of the engine under all conditions. Therefore, it has been proposed to provide a separate lubricating system wherein pressurized lubricant is delivered to certain highly stressed components of the engine, such as the bearings of the crankshaft. When the engine is used in conjunction with an outboard motor, the crankshaft is vertically disposed and it has been proposed to deliver pressurized oil to the main bearings of the crankshaft. This oil then flows by gravity down the crankshaft to lubricate the connecting rod big end journals. However, such an arrangement does not always insure that the connecting rod journals, which are one of the more highly loaded components of the engine, receive adequate lubrication under all running conditions. Frequently, when multiple cylinder engines are employed, a given crankshaft journal journals more than one connecting rod big end. Under these circumstances, it is particularly difficult to insure adequate lubrication of all of the connecting rod big end journals with the previously proposed lubricating systems.

It is, therefore, a principal object of this invention to provide an improved lubricating system for two-cycle engines.

It is another object of this invention to provide a separate lubricating system for two-cycle engines that insures adequate lubrication of the connecting rod big end journals.

It is a further object of this invention to provide a lubricating system for the connecting rod big end journals of a two-cycle, multiple cylinder engine.

SUMMARY OF THE INVENTION

This invention is adapted to be embodied in a lubricating system for internal combustion engines that have crankshafts supported for rotation about a generally vertically extending axis within a crankcase that defines a crank chamber in which a first portion of the crankshaft rotates. A connecting rod big end journal is formed on the crankshaft first portion for journaling the big end of a connecting rod. In accordance with the invention, means define a lubricant chamber sealed from and positioned above the crank chamber. The crankshaft has a second portion that extends into the lubricant chamber. A lubricant passage is formed in the crankshaft and has an inlet opening in the second portion that communicates with the lubricant chamber and a discharge opening that is formed in the connecting rod journal of the first portion for lubricating the connecting rod big end. Means are provided for delivering lubricant to the lubricant chamber.

BRIEF DESCRIPTION OF THE DRAWING

The single FIGURE of the drawing is a side elevational view of a two-cycle engine constructed in accordance with an embodiment of the invention, with portions broken away and other portions shown in section.

DETAILED DESCRIPTION OF THE PREFERRED EMBODIMENT

In the drawing, the reference numeral 11 indicates generally a two-cycle internal combustion engine constructed in accordance with this invention. In the illustrated embodiment, the engine 11 is of the V four type. It is to be understood, however, that the invention is capable of use in conjunction with engines of other cylinder numbers and cylinder configurations. Certain features of the invention, however, have particular utility in conjunction with engines wherein more than one connecting rod is journaled on a given crank journal or crank journal assembly of a crankshaft. Inasmuch as the invention relates to the lubrication of the connecting rod big end journals, only that portion of the engine 11 has been shown in detail. With respect to the other components of the engine which are not shown or described in detail, it is believed that their construction is well known to those skilled in the art and for that reason a detailed description is deemed to be unnecessary.

The engine 11 includes a cylinder block, indicated generally by the reference numeral 12, in which the respective cylinder bores (not shown) are formed. In view of the fact that, in the illustrated embodiment, the engine 11 is of the V type, the cylinder block 12 will have banks of cylinders in which respective cylinder bores are formed. Cylinder heads may be formed as separate parts affixed to the cylinder block 12 or may be formed integrally with the cylinder block 12 as is well known in this art. The engine 11 is particularly adapted for use in outboard motors and for this reason the engine 11 is disposed so that the crankshaft, to be described, rotates about a generally vertically extending axis. For this reason, the cylinder bores of the cylinder block 12 will be vertically disposed relative to each other.

A crankcase, indicated generally by the reference numeral 13, is affixed to the cylinder block 12 in a known manner. A crankshaft 14 is supported between the cylinder block 12 and crankcase 13 for rotation about a vertically extending axis by means of three spaced main bearing assemblies 15, 16, and 17. The main bearing assemblies 15, 16 and 17 respectively journal main bearing portions 18, 19, and 21 of the crankshaft 14. An oil seal 22 is disposed between the cylinder block 12, crankcase 13 and the upper portion of the crankshaft 14 so as to protect the uppermost main bearing 15. In a like manner, an oil seal 23 is disposed adjacent the lowermost main bearing 17 so as to protect this bearing.

The crankshaft 14 has a first throw 24 that is interposed between the bearings 15 and 16 and that defines a first connecting rod journal portion made up of spaced parts 25 and 26. In the illustrated embodiment, the parts 25 and 26 are coaxially disposed with respect to each other. As will become apparent, however, the invention is susceptible of use in engines wherein the connecting rod journals associated with each throw are not coaxial with each other or, in fact, certain features of the invention may be used in conjunction with engines wherein only a single connecting rod journal is formed on each throw.

The portion of the crankshaft 14 between the intermediate main bearing 16 and the lower main bearing 17 is formed with a second throw 27. The throw 27 is provided with a pair of spaced connecting rod big end journals 28 and 29 which, like the journals 25 and 26, are coaxial with each other in the illustrated embodiment.

The crankshaft throw 24 carries a pair of seals 31 and 32 that are positioned on opposite sides of the connecting rod journal portion 25. Also, the lower portion of the throw 24 is provided with a seal 33 which with the seal 32 isolate the connecting rod journal portion 26. The seals 31, 32 and 33, therefore, define respective, vertically disposed, sealed crankcase chambers 34 and 35. In a similar manner, the crankcase throw 27 carries seals 36, 37, and 38, which define lower, sealed crankcase chambers 39, 41, in which the respective connecting rod journals 28, 29, are disposed.

Pistons (not shown) are positioned in each of the cylinder bores and are connected by means of piston pins in a known manner to the upper ends of respective connecting rods 42. The connecting rods 42 have big end journal portions 43, each of which is journaled on a respective crankshaft connecting rod journal 25, 26, 28, 29 in a known manner. In this way, reciprocation of the pistons will effect rotation of the crankshaft 14.

The lower end of the crankshaft 14 is rotatably coupled, in any suitable manner, to a drive shaft 44. The drive shaft extends through the drive shaft housing (not shown) of the associated outboard motor and terminates in the lower unit which is also not shown for driving the propeller in any known manner.

Since the engine 11 is of the V type having four cylinders and the cylinder banks are disposed at a 90 degree angle to each other, the respective crank chambers 34, 35, 39, 41 undergo alternate expansions and contractions through a 90 degree phase difference. A combustible fuel/air mixture is delivered to the chambers 34, 35, from a carburetor 45 and interposed manifold 46. Preferably, reed type check valves are incorporated in the inlets to each of the chambers 34, 35, so as to prevent back flow. In a like manner, a carburetor 47 supplies the chambers 39, 41, through a manifold 48 and check valves (not shown). An air inlet device 49 is provided for delivering air to the inlets to the carburetors 45, 47 in a known manner.

As is conventional with two-cycle internal combustion engines, the fuel/air mixture supplied to the crankcase chambers 34, 35, 39, 41 by the carburetors 45, 47 may include lubricant for lubricating some components of the engine. However, the highly stressed connecting rod journals 43 are lubricated by a positive and separate lubrication system now to be described.

An oil pump, which may be of any known type, and is, therefore, shown schematically, is identified generally by the reference numeral 51. The oil pump 51 may be of the type driven by the engine 11 and, for example, may be of the diaphragm type actuated by change in pressure in the crankcase chambers 34, 35, 39, 41 or any of them. The oil pump 51 has a discharge line that communicates with a main oil delivery passage 52 formed in the crankcase 13. The oil delivery passage 52 has a first discharge 53 that communicates with a lubricant chamber 54 formed by the crankcase 13 and cylinder block 12 between the uppermost crankcase seal 31 and the upper main bearing 15. In a like manner, an oil discharge passage 55 intersects the main oil delivery passage 52 and a lubricant chamber 56 formed between the seal 33 and seal 36 above the crank chamber 39. Thus, the oil pump 51 will deliver oil to the two lubricant chambers 54, 56, above the crankshaft connecting rod journals 25, 26 and 28, 29, respectively.

The uppermost portion of the upper crank throw 24 extends into and rotates in the lubricant chamber 54. An oil delivery passage 57 extends vertically downwardly through the throw 24 from an inlet opening in the lubricant cavity 54 to a point in the crankshaft connecting rod journals 25, 26. The passage 57 is cross drilled, as at 58 and 59, so that lubricant may flow to the connecting rod big end journals 43 so as to lubricate these highly stressed journals and the associated portions 25, 26 of the crankshaft.

In a like manner, the crankshaft throw 27 has a portion that extends into the lubricant cavity 56. A lubricant delivery passage 61 extends vertically downwardly from an inlet opening in the lubricant cavity 56 through the crankshaft connecting rod journal portions 28 and 29. The passage 61 is cross drilled, as at 62 and 63, so as to lubricate the connecting rod big end journals 43 and also the crankshaft connecting rod journals 28, 29.

The lubricant which has lubricated the connecting rod big end journals 43 and the crankshaft connecting rod journals 25, 26, will be collected in the lowermost crankcase chambers 35, 41 for eventual return to the oil pump 51 through suitable oil return. Of course, a separate sump may be provided for the pump 51 so as to insure adequate lubricant makeup. The crankshaft main bearings 15, 16 and 17 may be lubricated in any suitable manner.

It should be readily apparent that during running of the engine 11, there will be adequate lubrication insured to the connecting rod big end journals 43 and the associated crankshaft connecting rod journals 25, 26, 28 and 29. As has been previously noted, in the illustrated embodiment, the crankshaft connecting rod journals 25, 26 and 28, 29 are coaxial with each other. It should be readily apparent that the invention is susceptible of use in an arrangement wherein these journals are not fully aligned. It is desirable, however, that these journals have some overlapping portion so that a single oil drilling may supply the oil from the lubricant cavities 54 and 56 to all of the respective journal portions. Of course, it should be understood that the invention may be used in conjunction with an arrangement wherein only a single connecting rod is journaled on each crankshaft throw. However, the invention has particular utility wherein there are a plurality of connecting rods journaled on one crankshaft throw since the arrangement insures adequate lubrication of a number of bearing portions. Various other changes and modifications may be made, without departing from the spirit and scope of the invention as defined by the appended claims.

We claim:

1. In a lubricating system for an internal combustion engine having a crankshaft supported for rotation about a generally vertically extending axis, a crankcase defining a crank chamber in which a first portion of said crankshaft rotates, and a connecting rod journal formed on said crankshaft first portion for journaling the big end of a connecting rod, the improvement comprising means defining a lubricant chamber sealed from and positioned above said crank chamber, said crankshaft having a second portion thereof extending into said lubricant chamber, a lubricant passage formed in said crankshaft and having an inlet opening in said second portion communicating with said lubricant chamber and a discharge opening formed in said connecting rod journal of said first portion for lubricating said connecting rod big end and means for delivering lubricant to said lubricant chamber.

2. In a lubricating system as set forth in claim 1 wherein the engine has a plurality of cylinders each having a respective vertically disposed crank chamber in which a respective crankshaft portion rotates.

3. In a lubricating system as set forth in claim 2 wherein there is a lubricant chamber formed vertically above the respective of each of said crank chambers.

4. In a lubricating system as set forth in claim 3 wherein there are a plurality of crank chambers and connecting rod journals associated with each of the lubricant chambers and vertically disposed beneath the respective lubricant chamber, there being a lubricant passage formed in the crankshaft communicating at its inlet end with the respective lubricant chamber and having outlet openings in each of the respective crankshaft connecting rod journal.

5. In a lubricating system as set forth in claim 4 wherein the respective crankshaft connecting rod journal associated with each lubricant chamber is aligned with each other.

6. In a lubricating system as set forth in claim 5 wherein the respective crankshaft connecting rod journals are coaxial.

7. In a lubricating system as set forth in claim 2 wherein there are a plurality of crank chambers and connecting rod journals associated with each of the lubricant chambers and vertically disposed beneath the respective lubricant chamber, there being a lubricant passage formed in the crankshaft communicating at its inlet end with the respective lubricant chamber and having outlet openings in each of the respective crankshaft connecting rod journals.

8. In a lubricating system as set forth in claim 7 wherein the respective crankshaft connecting rod journal associated with each lubricant chamber is aligned with each other.

9. In a lubricating system as set forth in claim 8 wherein the respective crankshaft connecting rod journals are coaxial.

* * * * *